US005212934A

United States Patent [19]

Brown

[11] Patent Number: 5,212,934

[45] Date of Patent: May 25, 1993

[54] SADDLE STIRRUP ATTACHMENT FOR USE BY CHILDREN

[76] Inventor: August R. Brown, 12598 Weld County Rd. 64 1/2, Greeley, Colo. 80631

[21] Appl. No.: 839,384

[22] Filed: Feb. 21, 1992

[51] Int. Cl.[5] ..... B68C 1/16

[52] U.S. Cl. ..... 54/46.1

[58] Field of Search ..... 54/44.1, 44.2, 46.1

[56] References Cited

U.S. PATENT DOCUMENTS

| | | | |
|---|---|---|---|
| 33,996 | 12/1861 | Johns | 54/44.1 |
| 1,572,796 | 2/1926 | Helm | 54/46.1 |
| 2,830,420 | 4/1958 | Smith | 54/46.1 |
| 3,112,592 | 12/1963 | Schindler | 54/44 |
| 4,164,834 | 8/1979 | Christensen | 54/46 |
| 4,608,812 | 9/1986 | Willson | 54/44 |
| 4,942,721 | 7/1990 | Van Scoyk | 54/46 |

*Primary Examiner*—Robert P. Swiatek
*Attorney, Agent, or Firm*—William E. Hein

[57] ABSTRACT

A stirrup attachment is fabricated for quick and easy positioning on a standard adult saddle so that the standard saddle may be safely used by youthful riders. The stirrup attachment includes a dome-shaped leather central section having an aperture therein through which the saddle horn of a standard saddle is received. The central section includes left and right strap extensions to which conventional adjustment sections and associated youth stirrups may be attached.

4 Claims, 1 Drawing Sheet

SADDLE STIRRUP ATTACHMENT FOR USE BY CHILDREN

BACKGROUND AND SUMMARY OF THE INVENTION

This invention relates generally to western saddles and more particularly to a stirrup attachment for standard size western saddles that includes shortened stirrups so that the saddle may be used by children.

The enjoyment of horseback riding by children has been hindered by the continued unavailability of low-cost alternatives to saddles of adult or standard size. This is because the stirrups on a standard saddle cannot be reached by children. So-called youth saddles that are simply scaled-down versions of standard saddles are available for use by younger children and youths on ponies. However, this alternative is generally economically prohibitive because of the cost of replacement as the user outgrows both the saddle and the pony.

Several accessories are known in the prior art for attachment to standard saddles that will permit their use by children. One such accessory is a piggyback saddle, simply a smaller saddle that mounts onto a standard saddle rather than directly onto the horse, as described in U.S. Pat. No. 3,111,592 to Schindler. This smaller saddle is mounted onto a standard saddle by means of straps on the front and rear of the smaller saddle that attach to the pommel and cantle of the standard saddle. The stirrups of the smaller saddle lie over the fender of the larger saddle. This accessory exhibits may of the same problems of youth saddles in that it is relatively expensive and quickly outgrown.

An auxilliary stirrup attachment, disclosed in U.S. Pat. No. 4,608,812, mounts onto a standard saddle by way of one set of straps that must be threaded through an opening in the pommel of the saddle and another set of straps that encircles the cantle of the standard saddle. This device includes several cumbersome straps and buckles that must be individually adjusted each time it is attached to or removed from the saddle.

A similar auxilliary stirrup attachment that may be mounted onto a standard saddle is disclosed in U.S. Pat. No. 4,154,834. This stirrup attachment includes a main strap having stirrups mounted on each end and a second strap centrally attached to the main strap. The second strap must also be threaded through the opening in the pommel so that the main strap extends over the saddle body with the stirrups over the fenders on either side of the standard saddle. This stirrup attachment also includes several cumbersome straps and buckles that must be individually adjusted each time it is attached to or removed from the saddle. In addition, it is not maintained in a fixed postion, but rather is free to move about, resulting in mispositioning of the stirrups, which may jeopardize the safety of a young rider.

Yet another stirrup attachment for a standard saddle is disclosed in U.S. Pat. No. 4,942,721 to Van Scoyk, involving a single strap having stirrups mounted on each end thereof. The central portion of the strap is first threaded forward through the opening in the pommel of the standard saddle and is then looped backward over the horn of the saddle. This attachment is cumbersome to install on the saddle and is also disadvantagous from a rider safety standpoint in that only a frictional force between the strap and the saddle horn holds the stirrups in positions equidistant from the centerline of the saddle. In the event the rider puts his or her weight on one or the other of the stirrups, this frictional force may not be sufficient to prevent slippage of the strap, and serious injury to the rider may result.

It is therefore the principal object of the present invention to provide a relatively inexpensive, simple stirrup attachment that may be quickly and easily positioned on a standard adult saddle so that the adult saddle may be safely used by youthful riders.

This and other objects are accomplished in accordance with the illustrated preferred embodiment of the present invention by providing a dome-shaped leather central section having an aperture therein through which the saddle horn of a standard saddle is received. The central section includes left and right strap extensions to which conventional stirrup adjustment sections and associated youth stirrups may be attached. In use, the stirrup attachment is simply placed over the saddle, with the saddle horn protruding through the aperture in the stirrup attachment, thereby maintaining the stirrup attachment in a secure forward position on the standard saddle. The stirrup adjustment sections are lengthened or shortened to raise or lower the youth stirrups in order to accommodate the particular needs of a youthful rider. These features also facilitate transfer of the stirrup attachment quickly and easily from one standard saddle to another without the need for buckling or unbuckling cumbersome attachment straps or for routing these attachment straps through an opening in the pommel of a saddle, as variously required to position prior art stirrup accessories.

DETAILED DESCRIPTION OF THE PREFERRED EMBODIMENT

Figure 1:
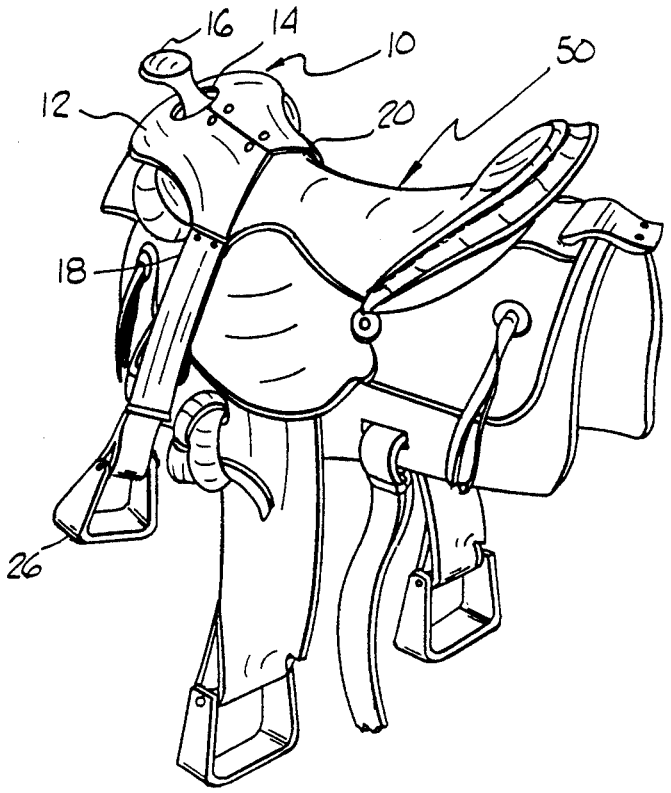
FIG. 1 is a pictorial diagram of a standard saddle in combination with the stirrup attachment of the present invention.
Figure 2:
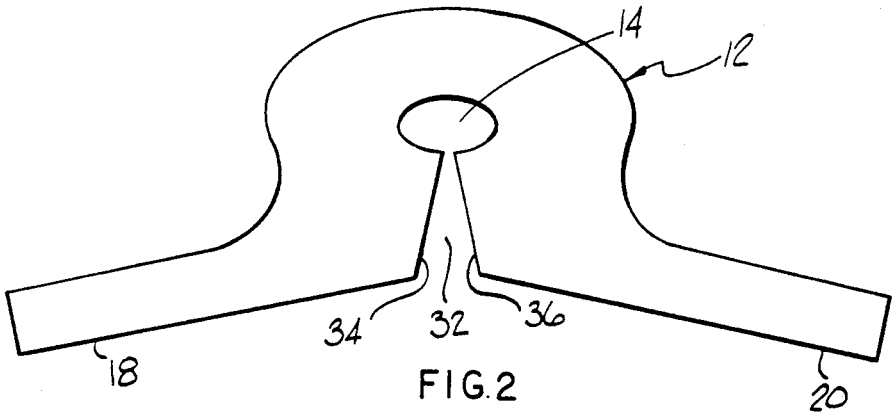
FIG. 2 is a diagram illustrating the pattern employed to form a central section of the stirrup attachment of the present invention.
Figure 3:
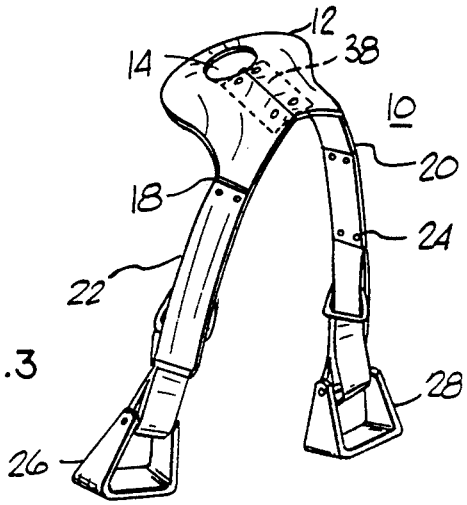
FIG. 3 is a pictorial diagram of the stirrup attachment constructed in accordance with the present invention.

Referring now to FIGS. 1–3, the stirrup attachment 10 of the present invention includes a central section 12 having a centrally located aperture 14 therein through which a saddle horn 16 of a conventional adult-size saddle 50 is received. The central section 12 of stirrup attachment 10 includes left and right strap extensions 18 and 20, to which conventional adjustment sections 22, 24 and associated youth stirrups 26, 28 may be attached, using well known riveting or other fastening techniques. The central section 12 of stirrup attachment 10, as well as adjustment sections 22, 24 may be conveniently fabricated using 10–11 oz. leather stock that is readily available through commercial sources.

Central section 12 of stirrup attachment 10 is preferably fabricated to be somewhat dome-shaped, rather than flat, so as to generally conform to the forward raised pommel portion of saddle 50 when the stirrup attachment 10 is placed over saddle horn 16. Formation of central section 12 of stirrup attachment 10 in this manner may be conveniently accomplished by cutting it from a flat piece of leather stock, according to the pattern illustrated in FIG. 2, to include circular aperture 14 and a pie-shaped or trapezoidal area 32 that is formed by removal of a section of corresponding shape of the flat leather stock that is rearward of and adjacent to aperture 14. The combination of circular aperture 14 and pie-shaped or trapezoidal area 32 appears as a keyhole-shaped cut-out in the leather stock. Facing edges 34, 36 of trapezoidal area 32 are then butted together and secured in that position using a gusset 38, illustrated in dotted line representation in FIG. 3. Gusset 38 is preferably mounted on the underside of central section 12, securely attached thereto using standard rivet fasteners, for example.

In use, stirrup attachment 10 of the present invention is simply placed over the forward portion of adult saddle 50 such that the saddle horn 16 is received through the aperture 14 in central section 12 of stirrup attachment 10, thereby holding it in place on adult saddle 50. Adjustment sections 22, 24 of stirrup attachment 10 may each include a conventional buckle arrangement for shortening or lengthening those sections to thereby raise or lower stirrups 26, 28 in order to accommodate the particular needs of a youthful rider. By positioning the dome-shaped stirrup attachment 10 over the pommel of saddle 50 with saddle horn 16 protruding through aperture 14, the stirrup attachment 10 is thereby securely held in the preferred position near the front of saddle 50. This arrangement permits the youthful rider to be seated forward in saddle 50 so that he or she may easily grasp saddle horn 16 for safety and leaves room for an adult rider to be seated behind the youthful rider, if desired. It also facilitates quick and easy transfer of stirrup attachment 10 from one standard saddle to another without the need for buckling or unbuckling cumbersome attachment straps or for routing these attachment straps through an opening in the pommel of a saddle, as variously required to position prior art stirrup accessories.

I claim:

1. A stirrup attachment adapted for positioning over the horn of a standard adult saddle to permit a person of small build to ride horseback using the saddle, the stirrup attachment comprising:

a dome-shaped central section having an aperture centrally located therein through which the saddle horn of said standard saddle is received, said dome-shaped central section including left and right strap extensions, said central section being cut from flat leather stock, a pie-shaped section thereof adjacent to and rearward of said apertures being removed therefrom, two facing edges of said central section exposed by removal of said pie-shaped section being joined to thereby impart a dome shape to said central section;

a first stirrup connected to the left strap extension; and a second stirrup connected to the right strap extension.

2. A stirrup attachment as in claim 1 further comprising:

a first adjustment strap coupling said first stirrup to said left strap extension for positioning the first stirrup a desired distance from said aperture; and a second adjustment strap coupling said second stirrup to said right strap extension for positioning the second stirrup a desired distance from said aperture.

3. A stirrup attachment as in claim 1 further comprising a gusset for joining said two facing edges of said central section.

4. A method of fabricating a youth stirrup attachment and mounting it to an adult saddle having an upwardly directed saddle horn, the method comprising the steps of:

cutting a central section from a piece of flat leather stock, the central section having left and right strap extensions and a keyhole-shaped opening therein;

joining facing peripheral edges of said keyhole-shaped opening to form said central section as a dome having a central circular aperture therein;

attaching left and right youth stirrups to said left and right strap extensions, respectively, to complete fabrication of said youth stirrup attachment; and placing the fabricated youth stirrup attachment over the adult saddle such that the saddle horn protrudes through said central circular aperture.

* * * * *